US010389040B2

(12) United States Patent
Karlsson

(10) Patent No.: US 10,389,040 B2
(45) Date of Patent: Aug. 20, 2019

(54) ANTENNA FEEDING NETWORK

(71) Applicant: CELLMAX TECHNOLOGIES AB, Kista (SE)

(72) Inventor: Dan Karlsson, Sollentuna (SE)

(73) Assignee: Cellmax Technologies AB, Kista (SE)

( * ) Notice: Subject to any disclaimer, the term of this patent is extended or adjusted under 35 U.S.C. 154(b) by 0 days.

(21) Appl. No.: 16/075,648

(22) PCT Filed: Jun. 9, 2017

(86) PCT No.: PCT/SE2017/050618
§ 371 (c)(1),
(2) Date: Aug. 4, 2018

(87) PCT Pub. No.: WO2017/213579
PCT Pub. Date: Dec. 14, 2017

(65) Prior Publication Data

US 2019/0051960 A1 Feb. 14, 2019

(30) Foreign Application Priority Data

Jun. 10, 2016 (SE) ..... 1650818

(51) Int. Cl.
*H01P 5/02* (2006.01)
*H01R 9/03* (2006.01)
*H01Q 21/00* (2006.01)

(52) U.S. Cl.
CPC ..... *H01Q 21/0006* (2013.01); *H01P 5/026* (2013.01); *H01R 9/038* (2013.01); *H01R 2201/02* (2013.01)

(58) Field of Classification Search
CPC .... H01Q 21/0006; H01Q 21/08; H01Q 21/26; H01Q 1/246; H01Q 3/30; H01P 5/04; H01P 5/026; H01P 3/06; H01R 2201/02
See application file for complete search history.

(56) References Cited

U.S. PATENT DOCUMENTS 5,801,600 A 9/1998 Butland et al.
6,683,582 B1 1/2004 Love
(Continued)

FOREIGN PATENT DOCUMENTS

CN 102714354 A 10/2012
EP 0575808 A1 12/1993
KR 20100117838 A 11/2010
WO WO8605325 A1 9/1986
WO WO02067374 A1 8/2002
WO WO2005060049 A1 10/2005
(Continued)

OTHER PUBLICATIONS

PCT/SE2016/050863, International Search Report, dated Dec. 16, 2016, Patent-och registreringsverket Box 5055 S-102 42 Stockholm, Sweden.

(Continued)

*Primary Examiner* — Robert Karacsony
(74) *Attorney, Agent, or Firm* — The Jansson Firm; Pehr B. Jansson

(57) ABSTRACT

An antenna feeding network for a multi-radiator antenna, the antenna feeding network comprising at least two coaxial lines, wherein each coaxial line comprises an elongated central inner conductor and an elongated outer conductor surrounding the central inner conductor. At least one connector device is configured to interconnect at least a first inner conductor and a second inner conductor of the central inner conductors. The connector device comprises at least one engaging portion, each being configured to engage with at least one corresponding surface portion formed on the envelope surface of the first or second inner conductor. The envelope surface is furthermore provided with at least one recess provided adjacent at least one surface portion.

22 Claims, 3 Drawing Sheets

(56) References Cited

U.S. PATENT DOCUMENTS

| | | | |
|---|---|---|---|
| 2001/0048351 | A1 | 12/2001 | Love |
| 2002/0135520 | A1 | 9/2002 | Teillet et al. |
| 2002/0135527 | A1 | 9/2002 | Teillet et al. |
| 2004/0203284 | A1 | 10/2004 | Stolle et al. |
| 2004/0263389 | A1 | 12/2004 | Haunberger et al. |
| 2005/0134517 | A1 | 6/2005 | Gottl |
| 2007/0241984 | A1 | 10/2007 | Schadler |
| 2008/0139044 | A1 | 6/2008 | Hantsch et al. |
| 2010/0001811 | A1 | 1/2010 | Haunberger et al. |
| 2010/0007571 | A1 | 1/2010 | Riedel |
| 2010/0201590 | A1 | 8/2010 | Girard et al. |
| 2010/0283710 | A1 | 11/2010 | Lutman et al. |
| 2013/0088402 | A1 | 4/2013 | Lindmark et al. |
| 2014/0035698 | A1 | 2/2014 | Schadler et al. |
| 2014/0139387 | A1 | 5/2014 | Jones et al. |
| 2015/0109183 | A1 | 4/2015 | Smith |
| 2015/0180135 | A1 | 6/2015 | Jonsson et al. |

FOREIGN PATENT DOCUMENTS

| | | | |
|---|---|---|---|
| WO | WO2005101566 | A1 | 10/2005 |
| WO | WO2006006913 | A1 | 1/2006 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE2016/050863, Written Opinion of the International Searching Authority, dated Dec. 16, 2016, Patent-och registreringsverket Box 5055 S-102 42 Stockholm, Sweden.

PCT/SE2017/050087, International Search Report, dated May 4, 2017, Patent-och registreringsverket Box 5055 S-10242 Stockholm, Sweden.

PCT/SE2017/050087, Written Opinion of the International Searching Authority, dated May 4, 2017, Patent-och registreringsverket Box 5055 S-10242 Stockholm, Sweden.

PCT/SE2017/050088, International Search Report, dated Apr. 28, 2017, Patent-och registreringsverket Box 5055 S-10242 Stockholm, Sweden.

PCT/SE2017/050088, Written Opinion of the International Searching Authority, dated Apr. 28, 2017, Patent-och registreringsverket Box 5055 S-10242 Stockholm, Sweden.

PCT/SE2017/050618, International Search Report, dated Aug. 30, 2017, Patent-och registreringsverket Box 5055 S-10242 Stockholm, Sweden.

PCT/SE2017/050618, Written Opinion of the International Searching Authority, dated Aug. 30, 2017, Patent-och registreringsverket Box 5055 S-10242 Stockholm, Sweden.

PCT/SE2016/050864, International Search Report, dated Nov. 30, 2016, Patent-och registreringsverket Box 5055 S-10242 Stockholm, Sweden.

PCT/SE2016/050864, Written Opinion of the International Searching Authority, dated Nov. 30, 2016, Patent-och registreringsverket Box 5055 S-10242 Stockholm, Sweden.

PCT/SE2016/050867, International Search Report, dated Dec. 14, 2016, Patent-och registreringsverket Box 5055 S-10242 Stockholm, Sweden.

PCT/SE2016/050867, Written Opinion of the International Searching Authority, dated Dec. 14, 2016, Patent-och registreringsverket Box 5055 S-10242 Stockholm, Sweden.

PCT/SE2016/050868, International Search Report, dated Dec. 16, 2016, Patent-och registreringsverket Box 5055 S-10242 Stockholm, Sweden.

PCT/SE2016/050868, Written Opinion of the International Searching Authority, dated Dec. 16, 2016, Patent-och registreringsverket Box 5055 S-10242 Stockholm, Sweden.

ANTENNA FEEDING NETWORK

FIELD OF THE INVENTION

The invention relates to the field of antenna feeding networks for multi-radiator antennas, which feeding network comprises air filled coaxial lines.

BACKGROUND

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of just one junction between 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at the common port, i.e. the input port in case of a splitter and the output port in case of a combiner.

A person skilled in the art would recognize that the feeding network is fully reciprocal in the sense that transmission and reception can be treated in the same way, and, to simplify the description of this invention, only the transmission case is described below.

The antenna feeding network may comprise a plurality of parallel coaxial lines being substantially air filled, each coaxial line comprising a central inner conductor at least partly surrounded by an outer conductor with insulating air in between. The coaxial lines and the reflector may be formed integrally with each other. The splitting may be done via crossover connections between inner conductors of adjacent coaxial lines.

In order to preserve the characteristic impedance, the lines connecting to the crossover element include impedance matching structures.

Unpublished patent application SE1551183-5 discloses an antenna feeding network comprising at least two coaxial lines, wherein each coaxial line comprises an central inner conductor and an outer conductor surrounding the central inner conductor, and wherein at least a first inner conductor and a second inner conductor are indirectly interconnected, for example by at least one connector device which engages with the inner conductors. It has been discovered that it may be difficult and/or expensive to manufacture connector devices which achieve the desired performance. The connector devices may be manufactured using for example extrusion, which requires the extruded part to be cut into appropriate lengths, thereby possibly causing burrs or protrusions at the ends thereof. Alternatively, if the connector devices are manufactured using casting, some form of protrusions may result from where the casting mould is divided. The burrs or protrusions may cause air gaps between the inner conductor and the connector device. This may cause degraded high frequency properties since the capacitance in the indirect interconnection is decreased, which may cause losses in the feeding network. Furthermore, if an insulating layer is provided to achieve indirect interconnection, the burrs or protrusions may cut through the insulating layer, regardless if it is provided on the connector device or on inner conductor, thereby causing undesired galvanic contact and passive intermodulation (PIM).

SUMMARY

An object of the present invention is to overcome at least some of the disadvantages of the prior art described above.

These and other objects are achieved by the present invention by means of an antenna feeding network according to a first aspect of the invention and an antenna arrangement according to a second aspect of the invention.

According to a first aspect of the invention, an antenna feeding network for a multi-radiator antenna is provided. The antenna feeding network comprises at least two coaxial lines, wherein each coaxial line comprises an elongated central inner conductor and an elongated outer conductor surrounding the central inner conductor, and at least one connector device configured to interconnect at least a first inner conductor and a second inner conductor of the central inner conductors. The connector device comprises at least one engaging portion, each being configured to engage with at least one corresponding surface portion formed on the envelope surface of the first or second inner conductor. The envelope surface is furthermore provided with at least one recess provided immediately adjacent at least one surface portion.

In other words, the envelope surface of the first or second inner conductor is provided with at least one surface portion arranged to be in abutment and in indirect or galvanic contact with a corresponding engaging portion of the connector device, and at least one recess adjacent the surface portion, which recess is adapted to be spaced apart from the engaging portion, i.e. neither in mechanical contact or in indirect or galvanic contact. It is understood that recess refers to a portion on the envelope surface which is recessed not only relative the envelope surface but also relative the surface portion, e.g. has a smaller diameter than the surface portion. Alternatively, the inventive concept may be described in that the envelope surface of the first or second inner conductor is provided with at least one recess at position(s) corresponding to axial end(s) of the engaging portion or at an intermediate position there between. Alternatively, the inventive concept may be described in that the envelope surface of the first or second inner conductor is provided with at least one recess at position(s) corresponding to that of burrs or protrusion(s) on the connector device(s). Each, or at least one engaging portion may have a longitudinal or axial length such that it extends at least partly over the at least one recess when the engaging portion is engaged with the at least one corresponding surface portion, i.e. the engaging portion may extend longitudinally or axially beyond the at least one corresponding surface portion over the adjacent recess or recesses.

The invention is based on the insight that, rather than going to great lengths trying to remove burrs or protrusions during manufacturing of the connector devices, it is more cost efficient and reliable to provide the inner conductors with recesses adapted to receive any burrs or protrusions therein. Thus, any contact between the connector device and the inner conductors is avoided altogether at positions where there is a risk for burrs or protrusions.

It is understood that coaxial line refers to an arrangement comprising an inner conductor and an outer conductor with insulating or dielectric material or gas in between, where the outer conductor is coaxial with the inner conductor in the sense that it completely or substantially surrounds the inner conductor. Thus, the outer conductor does not necessarily have to surround the inner conductor completely, but may be provided with openings or slots, which slots may even extend along the full length of the outer conductor. The coaxial lines may each be provided with air between the inner and outer conductors. In such embodiments, the air between the inner and outer conductors thus replaces the dielectric material often found in coaxial cables. It is further understood that the term substantially air filled is used to describe that the coaxial line is not necessarily provided only with air in between the outer and inner conductors, but may also be provided for example with support elements arranged to hold the inner conductors in position. The coaxial line may thus be described as substantially, but not completely, air filled.

It is understood that any directions referred to in this application relate to an antenna feeding network and multi-radiator base station antenna where a plurality of coaxial lines are arranged side by side in parallel to each other and also in parallel with a reflector on which the radiating elements are arranged. Longitudinally or axially in this context refers to the lengthwise direction of the coaxial lines, and sideways refers to a direction perpendicular to the lengthwise direction of the coaxial lines.

In embodiments, the envelope surface may be provided with recesses at both axial ends of said surface portion. In these embodiments, the surface portion may have an axial length which is slightly shorter than the axial length of the connector device and/or its engaging portions. In other words, the axial or longitudinal length of the at least one engaging portion may be slightly longer than the length of the axial or longitudinal length of the corresponding surface portion such that it extends longitudinally beyond the surface portion and at least partly over the adjacent recesses when the engaging portion is engaged with the surface portion. These embodiments are particularly advantageous when the connector device is manufactured by means of for example extrusion followed by cutting. Since the length of the surface portion is slightly shorter than that of the connector device/engaging portions, any burrs or protrusion caused by cutting the connector device into the desired length will be protrude into a corresponding recess, ensuring good indirect or galvanic contact between the connector device and the surface portion.

In other embodiments, the envelope surface may be provided with a recess at one axial end of the surface portion. In these embodiments, the surface portion may have an axial length which is slightly shorter than the axial length of the connector device and/or its engaging portions. In other words, the axial or longitudinal length of the at least one engaging portion may be slightly longer than the length of the axial or longitudinal length of the corresponding surface portion such that it extends longitudinally beyond the surface portion and at least partly over the adjacent recess when the engaging portion is engaged with the surface portion. These embodiments are particularly advantageous when the connector device is manufactured by means of moulding or sintering, where the mould is divided in such a manner that (possible) burrs or protrusions are formed at an end of the connector device. Since the length of the surface portion is slightly shorter than that of the connector device/engaging portions, any burrs or protrusion caused by the division of the mould will be protrude into a corresponding recess, ensuring good indirect or galvanic contact between the connector device and the surface portion.

In other embodiments, at least one of the engaging portions is configured to engage with at least two surface portions formed on said envelope surface, wherein said envelope surface is provided with a recess between said two surface portions. The engaging portion consequently extends longitudinally over the recess when the engaging portion is engaged with the surface portions. These embodiments are particularly advantageous when the connector device is manufactured by means of moulding or sintering. The dimensions and mutual positions of the two surface portions and the intermediate recess are preferably adapted to the dimensions of the connector device and the position of (possible) burrs or protrusions thereon caused by the division of the mould. Thereby, any burrs or protrusions will protrude into a corresponding recess, ensuring good indirect or galvanic contact between the engaging portion of the connector device and the surface portion.

In embodiments, the connector device is configured to interconnect first and second inner conductors indirectly. Herein the word indirectly means that conductive material of the connector device is not in direct physical contact with the conductive material of the first inner conductor and the second inner conductor, respectively. Indirectly thus means an inductive, a capacitive coupling or a combination of the two.

In embodiments, there may be at least one insulating layer arranged in between the conductive material of the connector device and the conductive material of the inner conductor, i.e. between the engaging portion and the corresponding surface portion(s). This at least one insulating layer may be arranged on the engaging portion(s) of the connector device and thus belong to the connector device and/or it may be arranged on the surface portion(s) of the first inner conductor or second inner conductor or on both inner conductors. The at least one insulating layer may alternatively comprise a thin film which is arranged between each engaging portion and the corresponding surface portion(s). The at least one insulating layer may also be described as an insulating coating. The insulating layer or insulating coating may be made of an electrically insulating material such as a polymer material or a non-conductive oxide material with a thickness of less than 200 μm, such as from 1 μm to 20 μm, such as from 5 μm to 15 μm, such as from 8 μm to 12 μm. Such a polymer or oxide layer may be applied with known processes and high accuracy on the connector device and/or on the inner conductor(s).

In embodiments, the connector device may be realized as a snap on element where each engaging portion is formed as a pair of snap on fingers, wherein each pair of snap on fingers are configured to be snapped onto the first or the second inner conductor to engage with corresponding surface portion(s). The bridge portion may be configured to connect with the other of the first or the second inner conductor, which is not engaged by the pair of snap on fingers, when the snap on element is snapped onto the first or second inner conductor. The snap on element may comprise two pairs of snap on fingers which are connected by the bridge portion, wherein the two pairs of snap on fingers may be configured to be snapped onto a first inner conductor and a second inner conductor, respectively. These preferred embodiments are advantageous since they allow convenient assembly of the antenna feeding network, where the connector device is simply snapped onto the first and/or second inner conductors. The connector device may also be arranged with two or more bridge portions, connecting three or more pairs of snap on fingers.

In embodiments, at least two of the outer conductors are provided with an opening, wherein said antenna feeding network further comprises at least one non-conductive holding element configured to be placed in the opening, wherein said non-conductive holding element comprises at least one passage adapted to receive said connector device therein.

In embodiments, the connector device is configured to be removably connected to the first inner conductor and/or the second inner conductor.

The embodiments described above may be combined in any practically realizable way.

According to a second aspect of the invention, a multi radiator base station antenna is provided, which antenna comprises an electrically conductive reflector, at least one radiating element arranged on the reflector and an antenna feeding network as described above.

In an embodiment of the multi-radiator antenna according to the second aspect of the invention, the electrically conductive reflector may comprise at least one opening on the front side or the back side, so that the connector device can be engaged with at least a first and a second inner conductor via said opening. The opening may advantageously be adapted to the size of the connector device. An opening may be assigned to each inner conductor pair of the antenna feeding network so that all inner conductors in the electrically conductive reflector may be connected by connector devices. In embodiments where the outer conductors are integrally formed with the reflector, the at least one opening may thus also be described as being provided in at least two of the outer conductors.

The above description with reference to the first aspect of the invention also applies to describe the second aspect of the invention and embodiments thereof.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
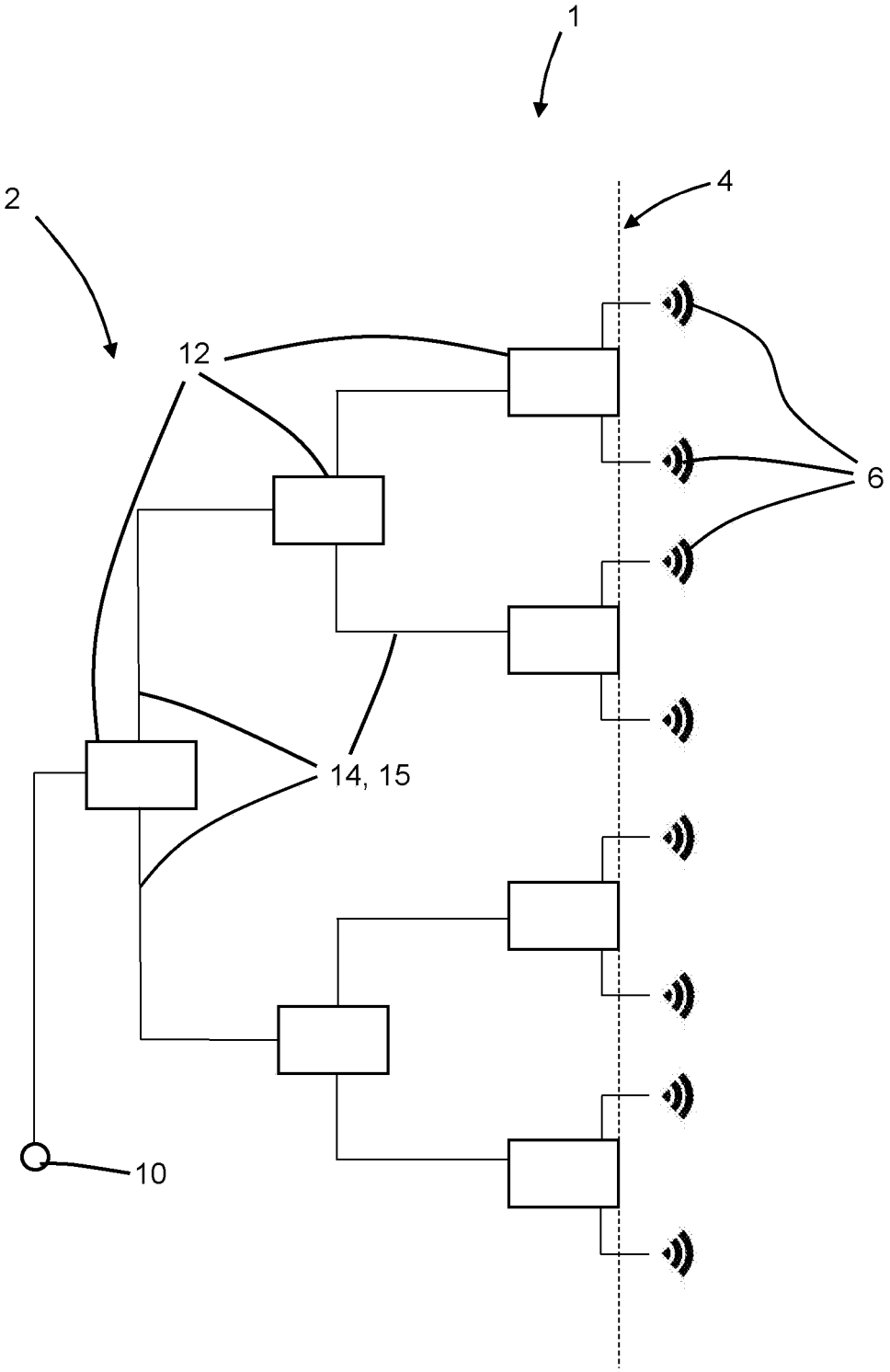
FIG. 1 schematically illustrates a multi-radiator antenna.

FIG. 1 schematically illustrates an antenna arrangement 1 comprising an antenna feeding network 2, an electrically conductive reflector 4, which is shown schematically in FIG. 1, and a plurality of radiating elements 6. The radiating elements 6 may be dipoles. The antenna feeding network 2 connects a coaxial connector 10 to the plurality of radiating elements 6 via a plurality of lines 14, 15, which may be coaxial lines, which are schematically illustrated in FIG. 1. The signal to/from the connector 10 is split/combined using, in this example, three stages of splitters/combiners 12.

Figure 2:
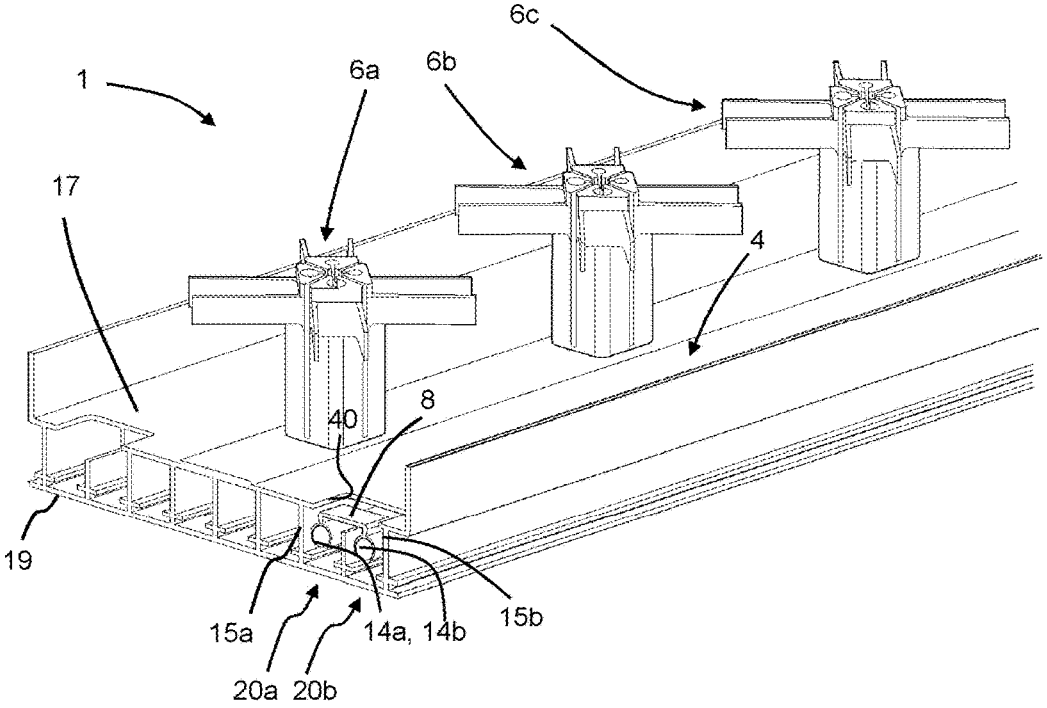
FIG. 2 schematically illustrates a perspective view of an embodiment of a multi-radiator antenna according to the second aspect of the invention.

FIG. 2 illustrates a multi-radiator antenna 1 in a perspective view, the antenna 1 comprising the electrically conductive reflector 4 and radiating elements 6*a-c*. The electrically conductive reflector 4 comprises a front side 17, where the radiating elements 6*a-c* are mounted and a back side 19. The shown view is a cross section through the coaxial lines 20*a-b*, the reflector 4, and the connector device 8.

A first coaxial line 20*a* comprises a first central inner conductor 14*a*, an elongated outer conductor 15*a* forming a cavity or compartment around the central inner conductor, and a corresponding second coaxial line 20*b* has a second inner conductor 14*b* and an elongated outer conductor 15*b*. The outer conductors 15*a*, 15*b* have square cross sections and are formed integrally and in parallel to form a self-supporting structure. The wall which separates the coaxial lines 20*a*, 20*b* constitute vertical parts of the outer conductors 15*a*, 15*b* of both lines. The first and second outer conductors 15*a*, 15*b* are formed integrally with the reflector 4 in the sense that the upper and lower walls of the outer conductors are formed by the front side 17 and the back side 19 of the reflector, respectively.

Although the first and second inner conductors 14*a*, 14*b* are illustrated as neighbouring inner conductors they may actually be further apart thus having one or more coaxial lines, or empty cavities or compartments, in between.

In FIG. 2 not all longitudinal channels or outer conductors are illustrated with inner conductors, it is however clear that they may comprise such inner conductors.

The front side 17 of the reflector comprises at least one opening 40 for the installation of the connector device 8. The opening 40 extends over the two neighbouring coaxial lines 20*a*, 20*b* so that the connector device 8 can engage the first and second inner conductors 14*a*, 14*b*.

Although the invention is illustrated with two neighbouring inner conductors 14*a*, 14*b* it falls within the scope to have an opening (not shown) that extends across more than two coaxial lines 20*a*, 20*b* and to provide a connector device 8 than can bridge two or even more inner conductors. Such a connector device (not shown) may thus be designed so that it extends over a plurality of coaxial lines between two inner conductors or over empty cavities or compartments. Such a connector device (not shown) may also be used to connect three or more inner conductors.

Figure 3:
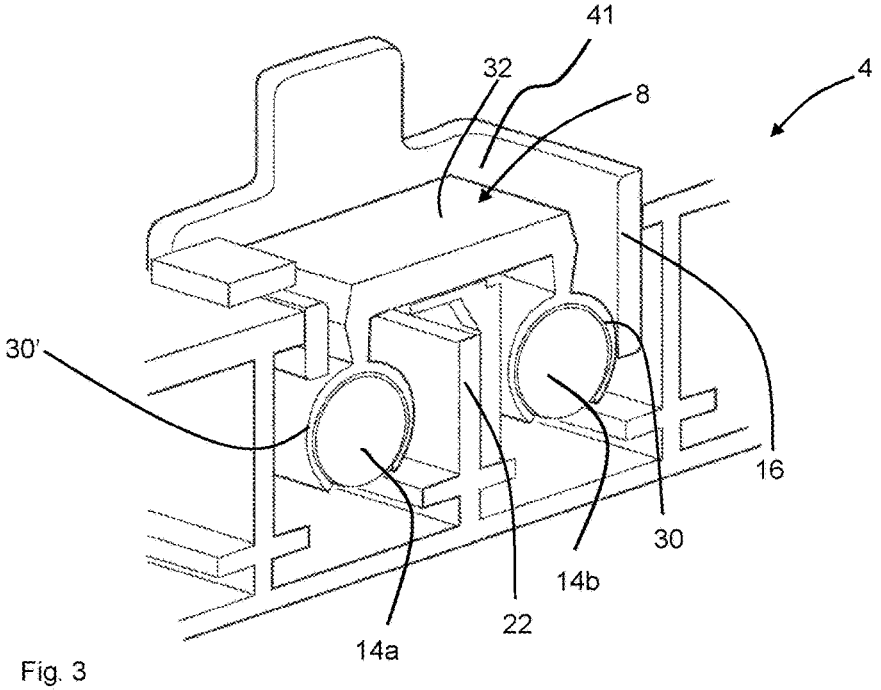
FIG. 3 schematically illustrates a perspective view of an embodiment of an antenna feeding network according to the first aspect of the invention.

In FIG. 3, an enlarged view of the opening and the connector device 8 arranged therein is illustrated. The connector device 8 is clipped or snapped onto the first inner conductor 14*a* and the second inner conductor 14*b*. The connection between the first inner conductor 14*a* and the second inner conductor 14*b* is electrically indirect, which means that it is either capacitive, inductive or a combination thereof. This is achieved by providing a thin insulating layer of a polymer material or some other insulating material (e.g. a non-conducting oxide) on the connector device 8. The insulating layer may have a thickness of 1 μm to 20 μm, such as from 5 μm to 15 μm, such as from 8 μm to 12 μm, or may have a thickness of 1 μm to 5 μm. The insulating layer may cover the entire outer surface of the connector device 8, or at least the engaging portions 30, 30' of the connector device 8 that engage the first and second inner conductors 14*a*, 14*b*.

The connector device 8 comprises a bridge portion 32 and two engaging portions, which are provided as two pairs of snap on fingers 30, 30'. One of the two pairs of snap on fingers 30' is arranged close to one end of the bridge portion 32 and the other of the two pairs of snap on fingers 30 is arranged close to the other end of the bridge portion 32. The two pairs of snap on fingers 30, 30' may be connected to the bridge portion 32 via connecting portions configured such that the bridge portion 32 is distanced from the first and second inner conductors 14*a*, 14*b*. In other embodiments, the snap on fingers 30, 30' are connected directly to the bridge portion 32. The connecting portions, as well as the other portions of the connector device, are shaped to optimize the impedance matching of the splitter/combiner formed by the connector device and the coaxial lines. The shape, or preferably the diameter of the connecting inner conductors may also contribute to the matching of the splitter/combiner.

As can be seen from FIG. 3, the vertical separating wall portion 22 is cut down to about two-thirds to three-quarters of its original height in the area of the opening 40 so that the connector device 8 does not protrude over the front side 17 of the electrically conductive reflector 4. In other embodiments, the wall portion 22 is cut down all the way to the floor of the outer conductors. The remaining height of the wall portion is adapted together with the other components, such as the connector device to optimize the impedance match.

It may be possible (not shown in the figures) to provide only one pair of snap on fingers, for example the pair of snap on fingers 30' engaging the first inner conductor 14*a* providing an indirect connection, and to let the other end of the bridge portion 32 contact the second inner conductor 14*b* directly without insulating layer or coating. This direct connection can be provided by connecting the bridge portion 32 to inner conductor 14*b* by means of a screw connection, or by means of soldering, or by making the bridge portion an integral part of inner conductor 14*b*, or by some other means providing a direct connection.

FIG. 3 further shows a holding element 41. The holding element is made of plastic, but may in other embodiments be made from other electrically insulating materials. The holding element 41 comprises a body portion having an opening or passage. The body portion is adapted to have a shape that corresponds at least more or less to the shape of the opening 40. The connector device 8 can be installed on the two inner conductors 14 after the holding element 41 is put in place. The connector device 8 is inserted and guided through the opening or passage when the two or more inner conductors are engaged. The holding element fixates the connector device 8 in the axial or lengthwise direction.

Figure 4:
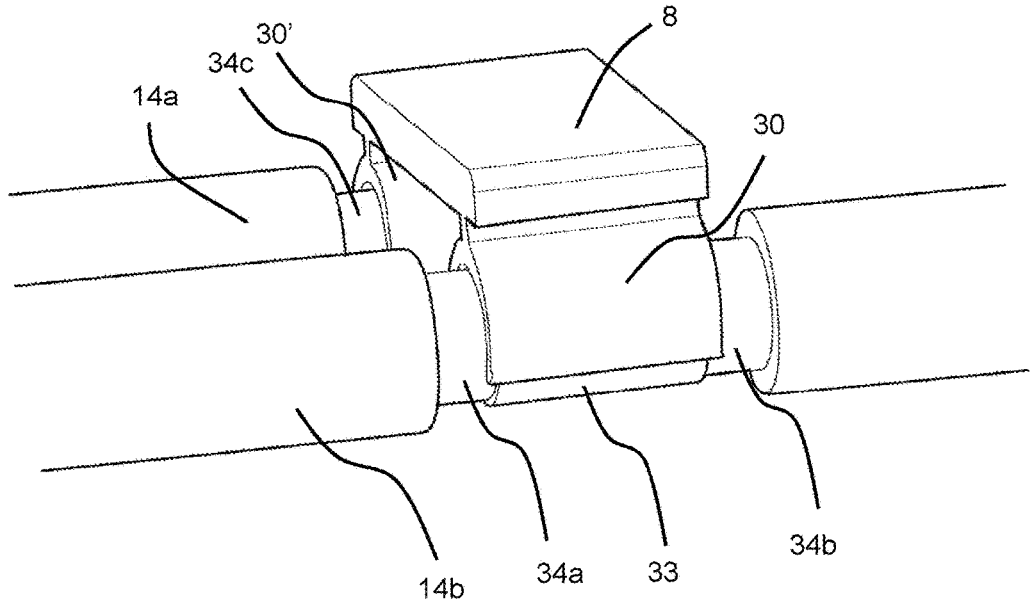
FIG. 4 schematically illustrates a perspective view of parts of an embodiment of an antenna feeding network according to the first aspect of the invention.

FIG. 4 shows a view of parts of an embodiment of the antenna feeding network, which embodiment is similar to the embodiment shown in FIGS. 2-3. A first engaging portion in the form of snap-on fingers 30 of the connector device 8 engage with a surface portion 33 formed on the envelope surface of the second inner conductor 14*b*. In this embodiment, the surface portion 33 is formed at a portion of the envelope surface which has a smaller diameter than the leftmost and rightmost portions of the second inner conductor shown in the figure. In other embodiments, the envelope surface may however have a uniform diameter. First and second recesses 34*a*, 34*b* are formed immediately (axially) adjacent the surface portion 33 at opposite axial ends thereof. A second engaging portion in the form of snap-on fingers 30' of the connector device 8 engage with a surface portion (not shown) formed on the envelope surface of the first inner conductor 14*a* near an end thereof. Third and fourth recesses are formed immediately (axially) adjacent the surface portion at opposite ends thereof. In the figure, only the third recess 34*c* is visible. The fourth recess (not visible) is formed at an axial end of the first inner conductor 14*a*. The recesses are provided as axial segments of the inner conductors 14*a*, 14*b* having a smaller diameter than the surface portions. The surface portions both have an axial extension which is slightly shorter than that of the connector device 8 such that any burrs or protrusion at the axial ends of the connector device caused by cutting the connector device into the desired length will be protrude into a corresponding recess 34*a-c* without making contact with the respective inner conductor. As can be seen in the figure, the engaging portion 30 has a longitudinal length greater than that of the surface portion 33, i.e. the engaging portion 30 has a longitudinal length or extension such that it extends partly over the first and second recesses 34*a-b*. The engaging portion 30' also has a longitudinal length greater than that of the corresponding surface portion, i.e. the engaging portion 30' has a longitudinal length or extension such that it extends partly over the third and fourth recesses.

Figure 5:
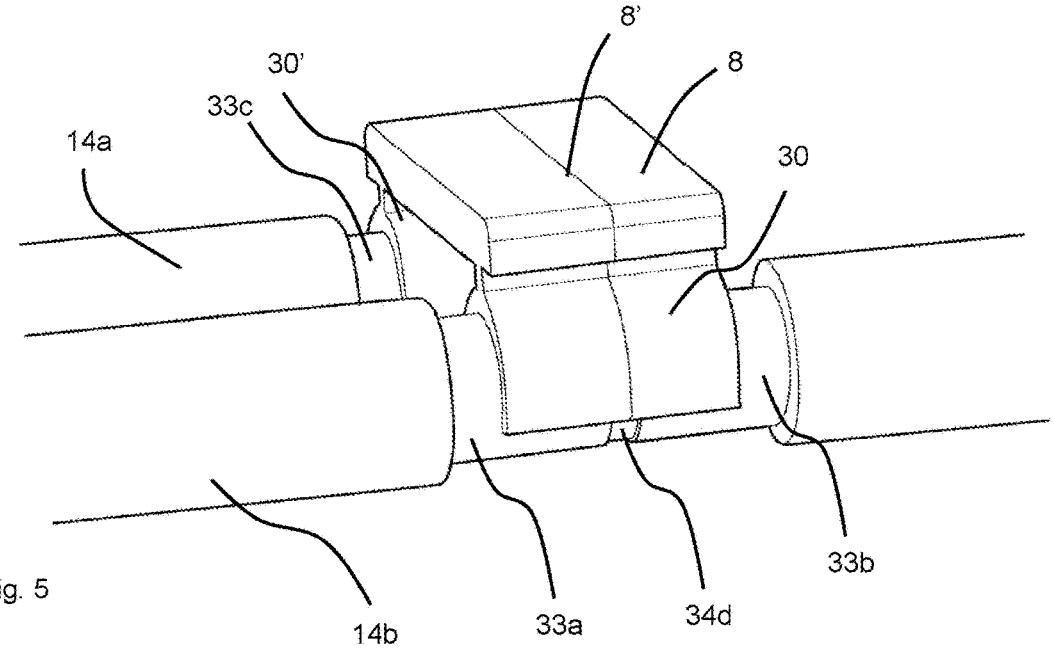
FIG. 5 schematically illustrates a perspective view of parts of another embodiment of an antenna feeding network according to the first aspect of the invention.

FIG. 5 shows a view of parts of an embodiment of the antenna feeding network, which embodiment is similar to the embodiment shown in FIG. 4. A first engaging portion in the form of snap-on fingers 30 of the connector device 8 engage with two surface portions 33*a*, 33*b* formed on the envelope surface of the second inner conductor 14*b*. In this embodiment, the surface portions 33*a-b* are formed at a portion of the envelope surface which has a smaller diameter than the leftmost and rightmost portions of the second inner conductor shown in the figure. In other embodiments, the envelope surface may however have a uniform diameter. A recess 34*d* is formed between the surface portions 33*a*, 33*b*, i.e. adjacent both surface portions. A second engaging portion in the form of snap-on fingers 30' of the connector device 8 engage with two surface portions (only one is visible: 33*c*) formed on the envelope surface of the first inner conductor 14*a* at the end thereof. A recess (not visible) is formed between the surface portions in the same way as on the second conductor 14*b*. The recesses are provided as axial segments of the inner conductors 14*a*, 14*b* having a smaller diameter than the surface portions. In this embodiment, the connector device 8 has been manufactured by moulding, causing a protrusion 8' at the middle (in the axial direction) of the connector device where the mould is divided. The recesses in the inner conductors are positioned and dimensioned such that the portions of the protrusion 8' which extends inwardly from the snap-on fingers 30, 30' extend into the respective recess without making contact with the respective inner conductor. As can be seen in the figure, the engaging portion 30 extends over recess 34*d*.

In the embodiments shown in FIGS. 4-5, the connector device 8 and the inner conductors 14*a*, 14*b* together form a splitter/combiner. When operating as a splitter, the inner conductor 14*a* is part of the incoming line, and the two ends of the inner conductor 14*b* are the two outputs of the splitter.

In the various embodiments described above, the connector device 8 is provided with a thin insulating layer on the connector device 8. The insulating layer may be formed of a polymer material or an electrically isolating oxide layer or a combination thereof, or by any other suitable material which achieves the desired insulating properties. It may however be possible to provide the first and second inner conductors 14*a*, 14*b* respectively with a thin insulating layer of a polymer material or an electrically isolating oxide layer or a combination thereof, or by any other suitable material which achieves the desired insulating properties. In embodiments, both the connector device and the first and second inner conductors are provided with insulating layers as described above. In other embodiments, the connector device may be provided without any insulating layer, or the first and second inner conductors may be provided without any insulating layers, i.e. only one of the connector device and first/second inner conductors is provided with an insulating layer. The insulating layer may cover the entire outer surface of the first and second inner conductors 14*a*, 14*b*, or at least the portions where snap on fingers 30, 30' of the connector device 8 engage the first and second inner conductors 14*a*, 14*b*. In other embodiments, an isolating material in the form of a thin foil is placed between the snap-on fingers 30, 30' and the inner conductor 14. Further, the connector device 8 has been described illustrating a first and a second inner conductor 14*a*, 14*b* in the antenna arrangement 1. The antenna arrangement 1 may however comprise more than one connector device 8 and a plurality of inner conductors 14*a*, 14*b*.

The description above and the appended drawings are to be considered as non-limiting examples of the invention. The person skilled in the art realizes that several changes and modifications may be made within the scope of the invention.

For example, the number of coaxial lines may be varied and the number of radiators/dipoles may be varied. Furthermore, the shape of the connector device and inner conductors and the placement of the insulating layer or coating may be varied. Furthermore, the reflector does not necessarily need to be formed integrally with the coaxial lines, but may on the contrary be a separate element. The scope of protection is determined by the appended patent claims.

The invention claimed is:

1. An antenna feeding network for a multi-radiator antenna, the antenna feeding network comprising at least two coaxial lines, wherein each coaxial line comprises an elongated central inner conductor and an elongated outer conductor surrounding the central inner conductor, further comprising at least one connector device configured to interconnect at least a first inner conductor and a second inner conductor of said central inner conductors, wherein the connector device comprises at least one engaging portion, each being configured to engage with at least one corresponding surface portion formed on an envelope surface of said first or second inner conductor, wherein said envelope surface is provided with at least one recess provided adjacent at least one surface portion, and wherein each engaging portion has a longitudinal length such that it extends at least partly over said at least one recess when said engaging portion engages with said at least one corresponding surface portion.

2. The antenna feeding network according to claim 1, wherein said envelope surface is provided with a recess at an axial end of said surface portion.

3. The antenna feeding network according to claim 1, wherein said envelope surface is provided with recesses at both axial ends of said surface portion.

4. The antenna feeding network according to claim 2, wherein said surface portion has a longitudinal length which is slightly shorter than the longitudinal length of the connector device and/or its engaging portions.

5. The antenna feeding network according to claim 1, wherein at least one of said engaging portions is configured to engage with at least two surface portions formed on said envelope surface, wherein said envelope surface is provided with a recess between said two surface portions.

6. The antenna feeding network according to claim 1, wherein said coaxial lines are substantially air filled coaxial lines, each being provided with air between the inner and outer conductors.

7. The antenna feeding network according to claim 1, wherein said connector device is configured to interconnect first and second inner conductors indirectly.

8. The antenna feeding network according to claim 1, wherein an insulating layer is provided on said at least one engaging portion and/or on said at least one surface portion.

9. The antenna feeding network according to claim 1, wherein said connector device is provided as a snap on element, wherein each engaging portion is formed as a pair of snap on fingers, wherein each pair of snap on fingers are adapted to be snapped onto the first or the second inner conductor.

10. The antenna feeding network according to claim 1, wherein at least two of the outer conductors are provided with an opening, wherein said antenna feeding network further comprises at least one non-conductive holding element configured to be placed in the opening, wherein said non-conductive holding element comprises at least one passage adapted to receive said connector device therein.

11. The antenna feeding network according to claim 1, wherein the connector device is configured to be removably connected to the first inner conductor and the second inner conductor.

12. A multi-radiator antenna comprising:

an antenna feeding network comprising:

at least two coaxial lines, wherein each coaxial line comprises an elongated central inner conductor and an elongated outer conductor surrounding the central inner conductor, further comprising at least one connector device configured to interconnect at least a first inner conductor and a second inner conductor of said central inner conductors, wherein the connector device comprises at least one engaging portion, each being configured to engage with at least one corresponding surface portion formed on an envelope surface of said first or second inner conductor, wherein said envelope surface is provided with at least one recess provided adjacent at least one surface portion, and wherein each engaging portion has a longitudinal length such that it extends at least partly over said at least one recess when said engaging portion engages with said at least one corresponding surface portion; and radiating elements being connected to said antenna feeding network.

13. The multi-radiator antenna of claim 12, wherein said envelope surface is provided with a recess at an axial end of said surface portion.

14. The multi-radiator antenna according to claim 12, wherein said envelope surface is provided with recesses at both axial ends of said surface portion.

15. The multi-radiator antenna according to claim 13, wherein said surface portion has a longitudinal length which is slightly shorter than the longitudinal length of the connector device and/or its engaging portions.

16. The multi-radiator antenna according to claim 12, wherein at least one of said engaging portions is configured to engage with at least two surface portions formed on said envelope surface, wherein said envelope surface is provided with a recess between said two surface portions.

17. The multi-radiator antenna according to claim 12, wherein said coaxial lines are substantially air filled coaxial lines, each being provided with air between the inner and outer conductors.

18. The multi-radiator antenna to claim 12, wherein said connector device is configured to interconnect first and second inner conductors indirectly.

19. The multi-radiator antenna to claim 12, wherein an insulating layer is provided on said at least one engaging portion and/or on said at least one surface portion.

20. The multi-radiator antenna to claim 12, wherein said connector device is provided as a snap on element, wherein each engaging portion is formed as a pair of snap on fingers, wherein each pair of snap on fingers are adapted to be snapped onto the first or the second inner conductor.

21. The multi-radiator antenna according to claim 12, wherein at least two of the outer conductors are provided with an opening, wherein said antenna feeding network further comprises at least one non-conductive holding element configured to be placed in the opening, wherein said non-conductive holding element comprises at least one passage adapted to receive said connector device therein.

22. The multi-radiator antenna according to claim 12, wherein the connector device is configured to be removably connected to the first inner conductor and the second inner conductor.

* * * * *